US012660910B2

(12) United States Patent
Russo

(10) Patent No.: US 12,660,910 B2
(45) Date of Patent: Jun. 23, 2026

(54) CLEANING BRUSH FOR CLEANING TOOLS SUCH AS TROWELS AND GROUT FLOATS

(71) Applicant: Russo Trading Company, Inc., Menomonee Falls, WI (US)

(72) Inventor: William Phillip Russo, Delafield, WI (US)

(73) Assignee: RUSSO TRADING COMPANY, INC., Menomonee Falls, WI (US)

( * ) Notice: Subject to any disclaimer, the term of this patent is extended or adjusted under 35 U.S.C. 154(b) by 492 days.

(21) Appl. No.: 18/181,990

(22) Filed: Mar. 10, 2023

(65) Prior Publication Data

US 2023/0301422 A1 Sep. 28, 2023

Related U.S. Application Data

(60) Provisional application No. 63/356,305, filed on Jun. 28, 2022, provisional application No. 63/269,788, filed on Mar. 23, 2022.

(51) Int. Cl.
*A46B 5/00* (2006.01)
*A46B 9/02* (2006.01)

(52) U.S. Cl.
CPC ..... *A46B 5/0012* (2013.01); *A46B 9/02* (2013.01); *A46B 2200/3073* (2013.01)

(58) Field of Classification Search
CPC . A46B 2200/3073; A46B 5/0012; A46B 9/02; A63B 57/60; A47L 21/00; A47L 13/34; A47L 23/22; A47K 7/026
USPC ..... 15/106, 111
See application file for complete search history.

(56) References Cited

U.S. PATENT DOCUMENTS

| | | | | |
|---|---|---|---|---|
| 531,412 | A | 12/1894 | Garvey | |
| 850,396 | A | 4/1907 | Polt | |
| D45,746 | S | 5/1914 | Fernandez | |
| 1,219,051 | A * | 3/1917 | Tallaksen | A46B 9/02 15/160 |
| D76,460 | S | 10/1928 | De Vilbiss | |
| 1,860,306 | A * | 5/1932 | Biener | D06F 53/005 15/160 |
| D99,144 | S | 3/1936 | Sundin | |
| 2,043,758 | A * | 6/1936 | Lay | A46B 9/06 15/159.1 |
| 2,051,009 | A | 8/1936 | Porter | |

(Continued)

FOREIGN PATENT DOCUMENTS

| | | | | |
|---|---|---|---|---|
| KR | 200473198 Y1 * | 6/2014 | | A47L 23/22 |
| WO | WO9524175 A1 | 9/1995 | | |
| WO | WO9849919 A1 | 11/1998 | | |

OTHER PUBLICATIONS

Contractor Talk forum, "Best Way to Clean Trowels & Levels?", https://www.contractortalk.com/threads/best-way-to-clean-trowels-levels.92302/, 2011. (Year: 2011).*

(Continued)

*Primary Examiner* — Laura C Guidotti
(74) *Attorney, Agent, or Firm* — KLINTWORTH & ROZENBLAT LLP

(57) ABSTRACT

A cleaning brush includes first and second rigid base parts which are coupled together by a coupler. Each base part has bristles extending therefrom. Free ends of the bristles extending from the first base part face free ends of the bristles extending from the second base part.

20 Claims, 11 Drawing Sheets

(56) References Cited

U.S. PATENT DOCUMENTS

| | | | | |
|---|---|---|---|---|
| 2,237,761 | A * | 4/1941 | Leano | A47L 21/00 15/160 |
| D153,413 | S | 4/1949 | Baumgartner | |
| 2,591,331 | A | 4/1952 | Baumbach | |
| 2,611,916 | A | 9/1952 | Peters | |
| 2,898,620 | A | 8/1959 | Dickinson | |
| D207,253 | S | 3/1967 | Tucker | |
| 3,387,313 | A | 6/1968 | Smith et al. | |
| D278,390 | S | 4/1985 | Bailey | |
| 4,617,917 | A * | 10/1986 | Miller | A47K 7/026 15/207.2 |
| D295,118 | S | 4/1988 | Valenza | |
| 4,821,358 | A | 4/1989 | Wyckoff et al. | |
| D320,292 | S | 9/1991 | Bartlett | |
| 5,094,557 | A | 3/1992 | Nelson et al. | |
| 5,321,867 | A | 6/1994 | Probst | |
| 5,432,971 | A | 7/1995 | Chung | |
| 5,794,301 | A | 8/1998 | Hietala | |
| 5,878,460 | A | 3/1999 | Bruce | |
| 6,216,306 | B1 | 4/2001 | Esterson et al. | |
| D454,250 | S | 3/2002 | Forrest | |
| D536,176 | S | 2/2007 | Ramirez | |
| D576,803 | S | 9/2008 | Meyer | |
| D576,804 | S | 9/2008 | Pulfrey | |
| 8,196,250 | B2 | 6/2012 | Kawka | |
| D684,375 | S | 6/2013 | Bona-Kustra | |
| 8,607,397 | B1 | 12/2013 | Caver | |
| D703,956 | S | 5/2014 | Treeby et al. | |
| 8,726,445 | B1 * | 5/2014 | Wagner | A47K 7/024 4/606 |
| 8,893,735 | B2 | 11/2014 | Shatz | |
| D765,420 | S | 9/2016 | Suh | |
| D792,034 | S | 7/2017 | Dornbierer | |
| D817,006 | S | 5/2018 | Kinoshita | |
| D941,589 | S | 1/2022 | Chen | |
| D974,770 | S | 1/2023 | Bixby et al. | |
| D1,010,949 | S | 1/2024 | Jack | |
| D1,018,068 | S | 3/2024 | Eimer | |
| D1,022,475 | S | 4/2024 | Sun | |
| D1,023,587 | S | 4/2024 | Gibson | |
| D1,065,841 | S | 3/2025 | Matsushita | |
| 2002/0152568 | A1 * | 10/2002 | Dillinger | B08B 1/12 15/160 |
| 2009/0211046 | A1 | 8/2009 | Kawka | |
| 2023/0079201 | A1 | 3/2023 | Shock | |
| 2025/0009116 | A1 | 1/2025 | Russo | |

OTHER PUBLICATIONS

International Search Report and Written Opinion for PCT/US2023/064723 mailed dated Jul. 17, 2023, 13 pages.

Partial Search Report issued in connection with EP Application No. EP24198728.8 dated Jan. 21, 2025, 17 pages.

Extended European Search Report issued in connection with EP application No. 23775827.1 dated Oct. 6, 2025.

* cited by examiner

CLEANING BRUSH FOR CLEANING TOOLS SUCH AS TROWELS AND GROUT FLOATS

CROSS-REFERENCE TO RELATED APPLICATION(S)

This application claims priority to U.S. provisional application Ser. No. 63/269,788 filed on Mar. 23, 2022 and U.S. provisional application Ser. No. 63/356,305 filed on Jun. 28, 2022, the contents of which are incorporated herein in its entirety.

FIELD OF THE DISCLOSURE

The present disclosure relates to a cleaning brush that is used to clean tools, such as tiling tools.

BACKGROUND

During use, tools become caked with contaminants and must be cleaned. Contractors typically use a bucket of water and a towel or sponge to clean the tools or a brush having bristles on one side of the brush for cleaning the tools. Some tools have sharp edges which can cut the towel or sponge, and some tools are awkward and not easily cleaned.

A cleaning brush is provided herein which provides improvements to the existing prior art and which overcomes the disadvantages presented by the prior art. Other features and advantages will become apparent upon a reading of the attached specification, in combination with a study of the drawings.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
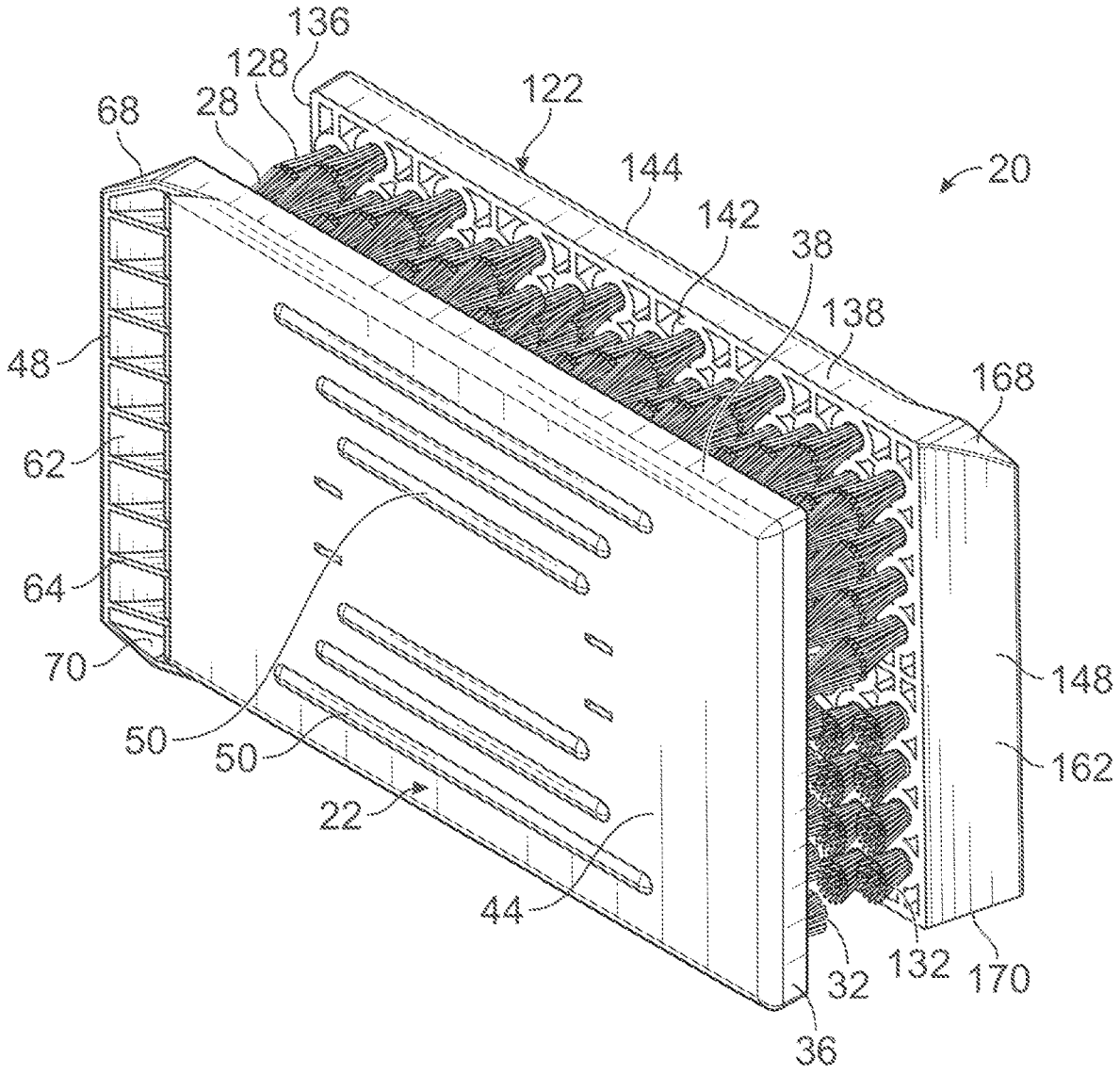
FIG. 1 depicts a perspective view of a cleaning brush in accordance with a first embodiment of the disclosure.
Figure 2:
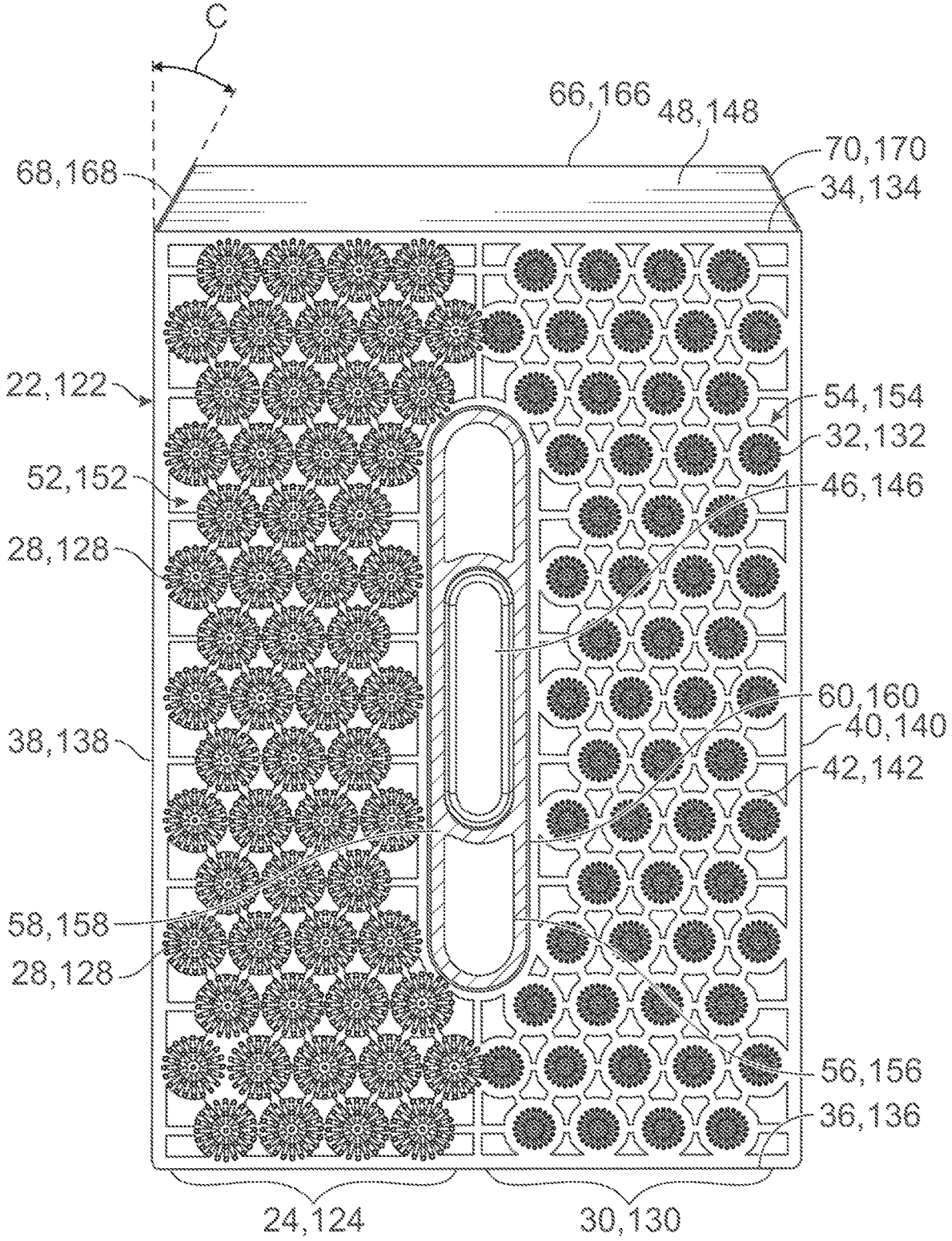
FIG. 2 depicts a plan view of a base part of the cleaning brush, showing a plurality of bristles.
Figure 3:
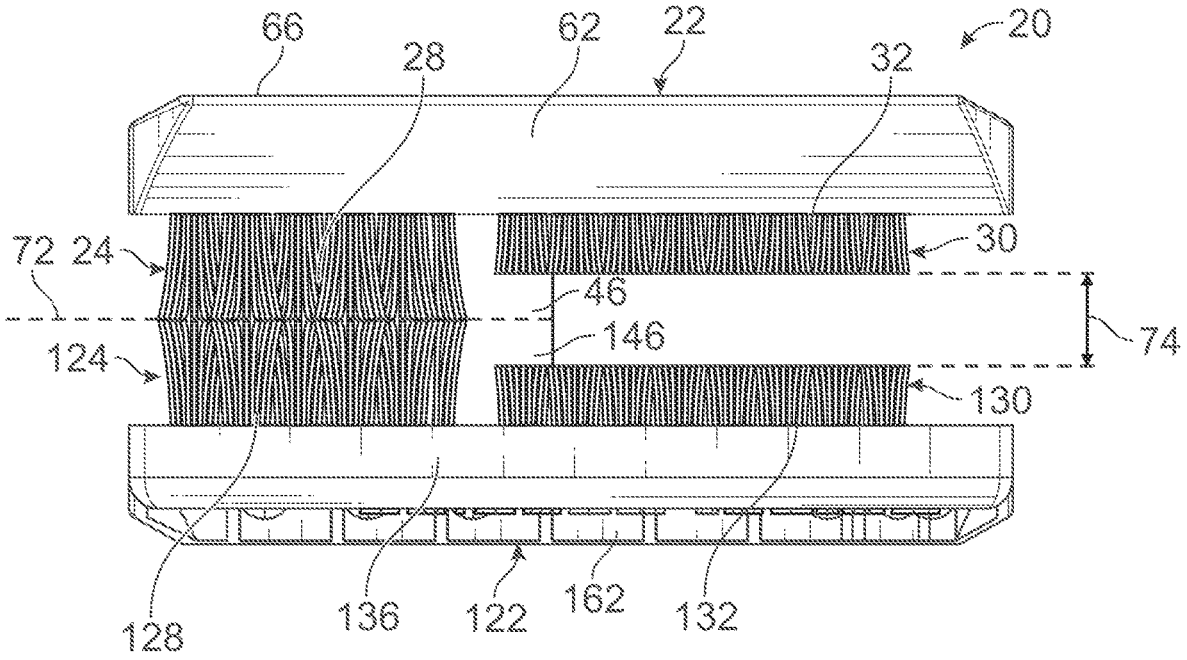
FIG. 3 depicts an end plan view of the cleaning brush.
Figure 4:
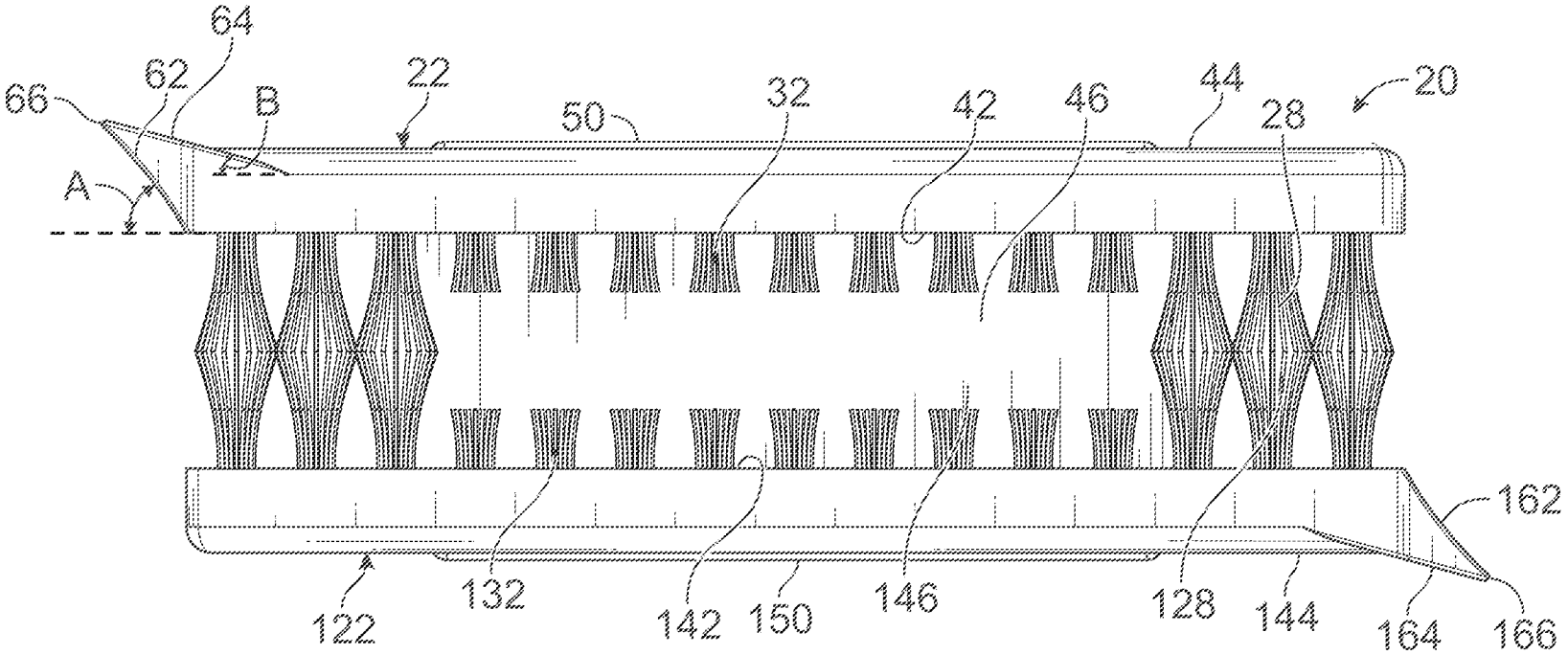
FIG. 4 depicts a side elevation view of the cleaning brush.
Figure 5:
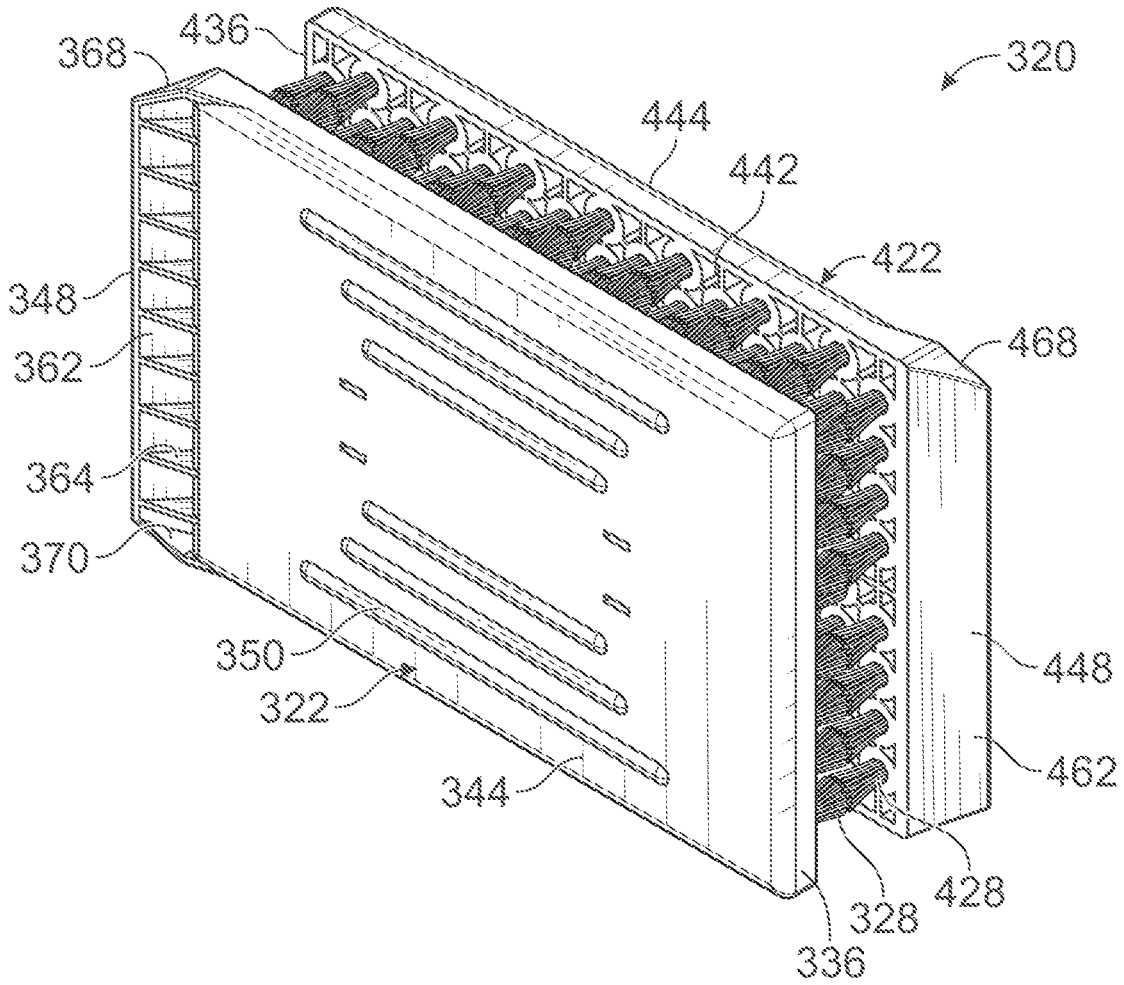
FIG. 5 depicts a perspective view of a cleaning brush in accordance with a second embodiment of the disclosure.
Figure 6A:
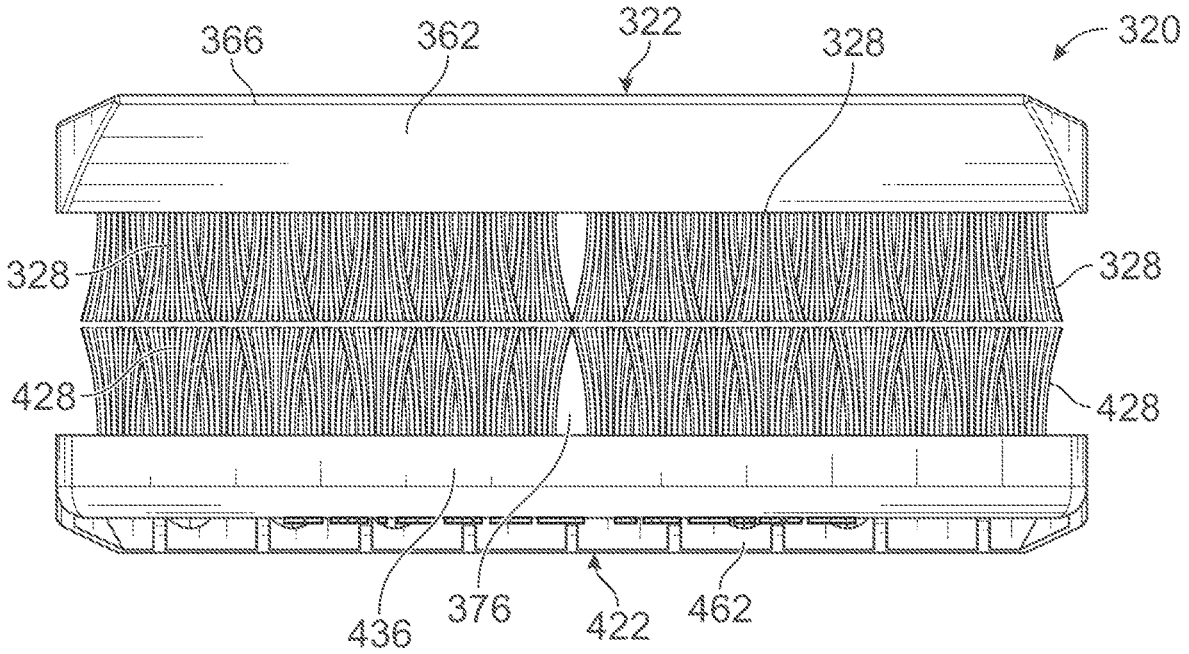
FIG. 6A depicts an end plan view of the cleaning brush of FIG. 5.
Figure 6B:
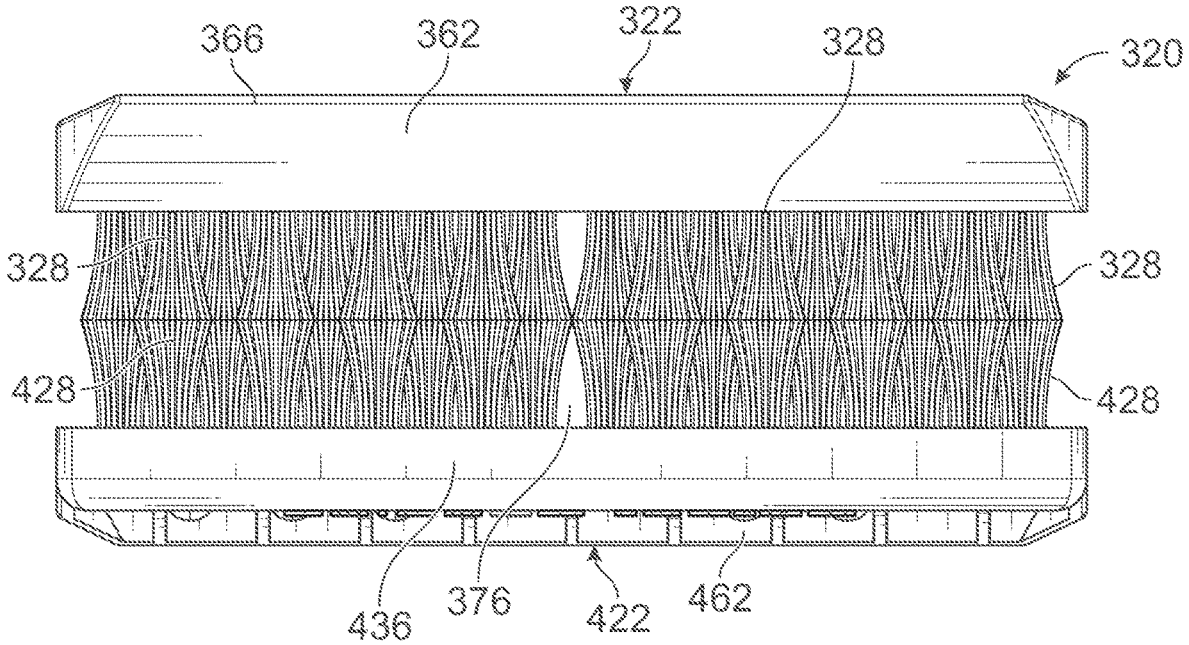
FIG. 6B depicts an end plan view of an alternative embodiment of the cleaning brush of FIG. 5.
Figure 7:
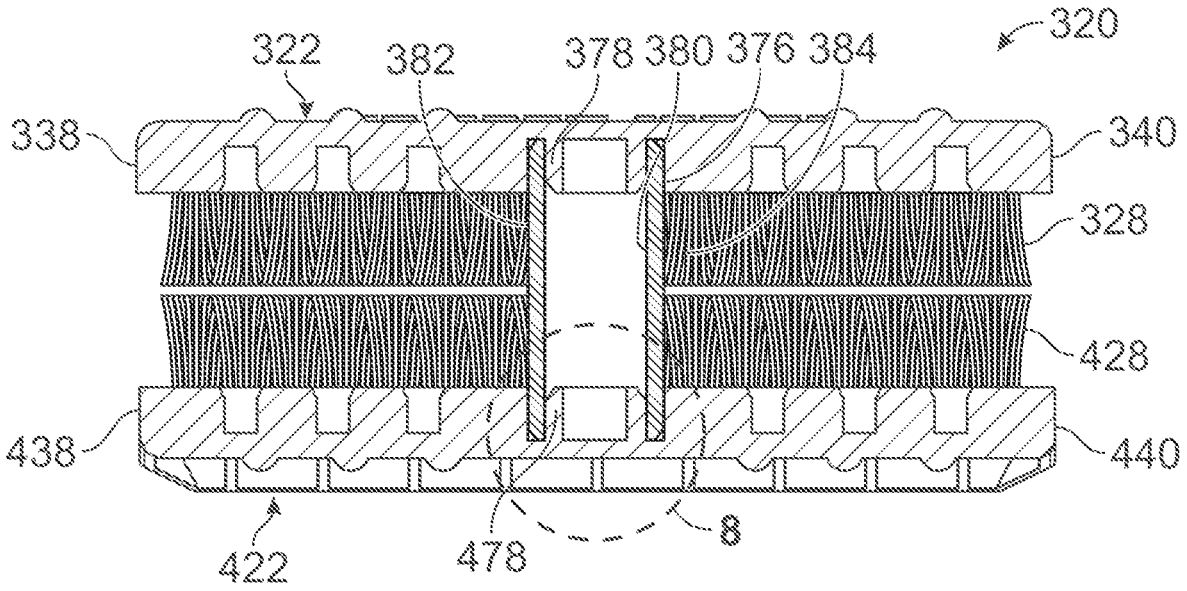
FIG. 7 depicts a cross-sectional view of the cleaning brush of FIG. 5.
Figure 8:
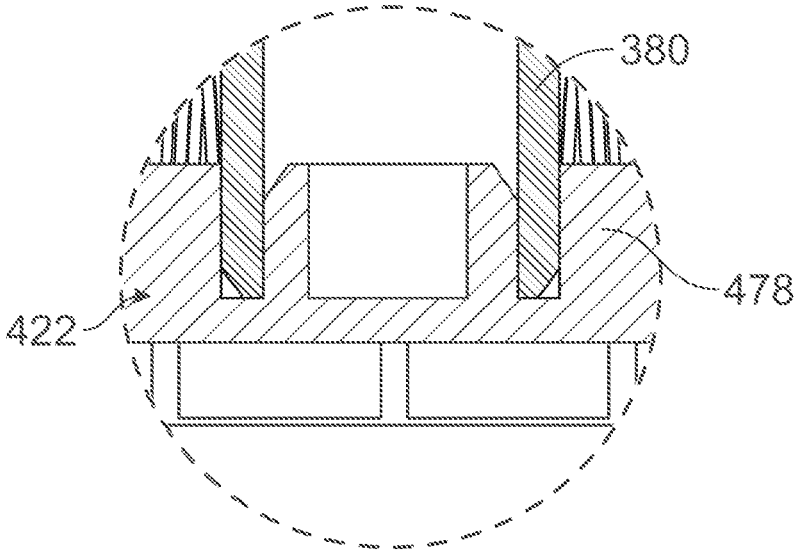
FIG. 8 depicts an enlarged view of area 8 in FIG. 7.
Figure 9:
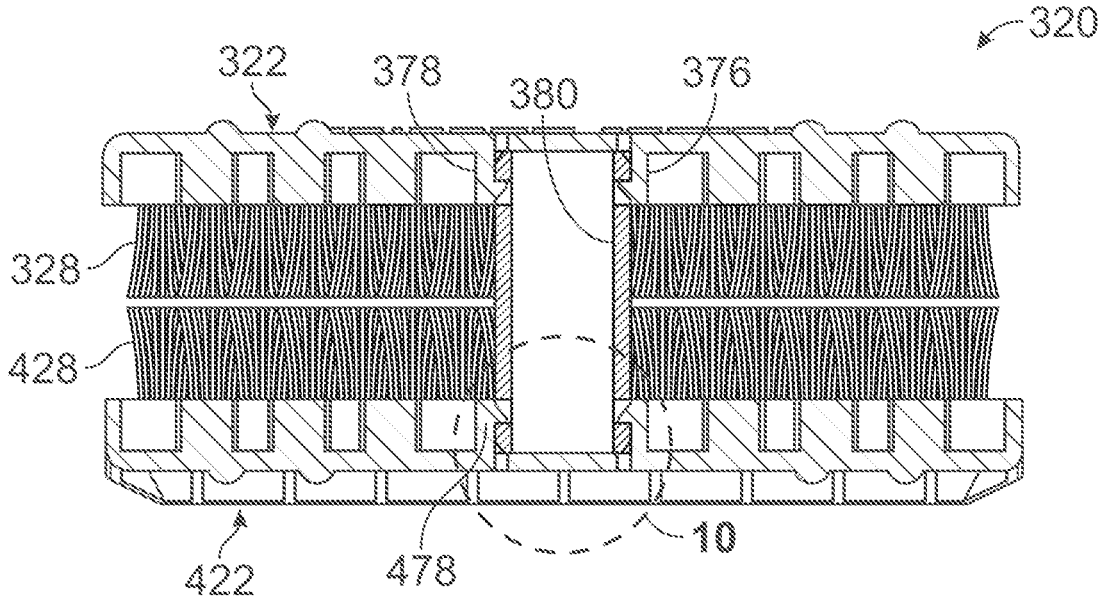
FIG. 9 depicts another cross-sectional view of the cleaning brush of FIG. 5.
Figure 10:
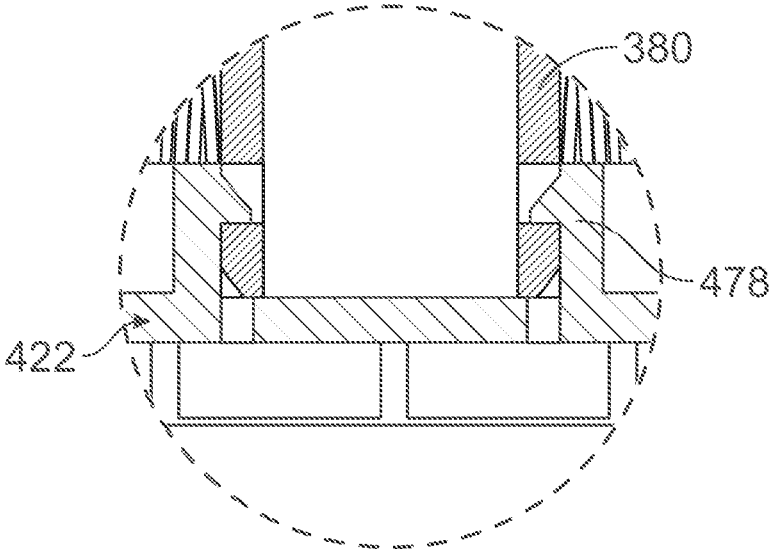
FIG. 10 depicts an enlarged view of area 10 in FIG. 9.

While the disclosure may be susceptible to embodiment in different forms, there is shown in the drawings, and herein will be described in detail, specific embodiments with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Figure 11:
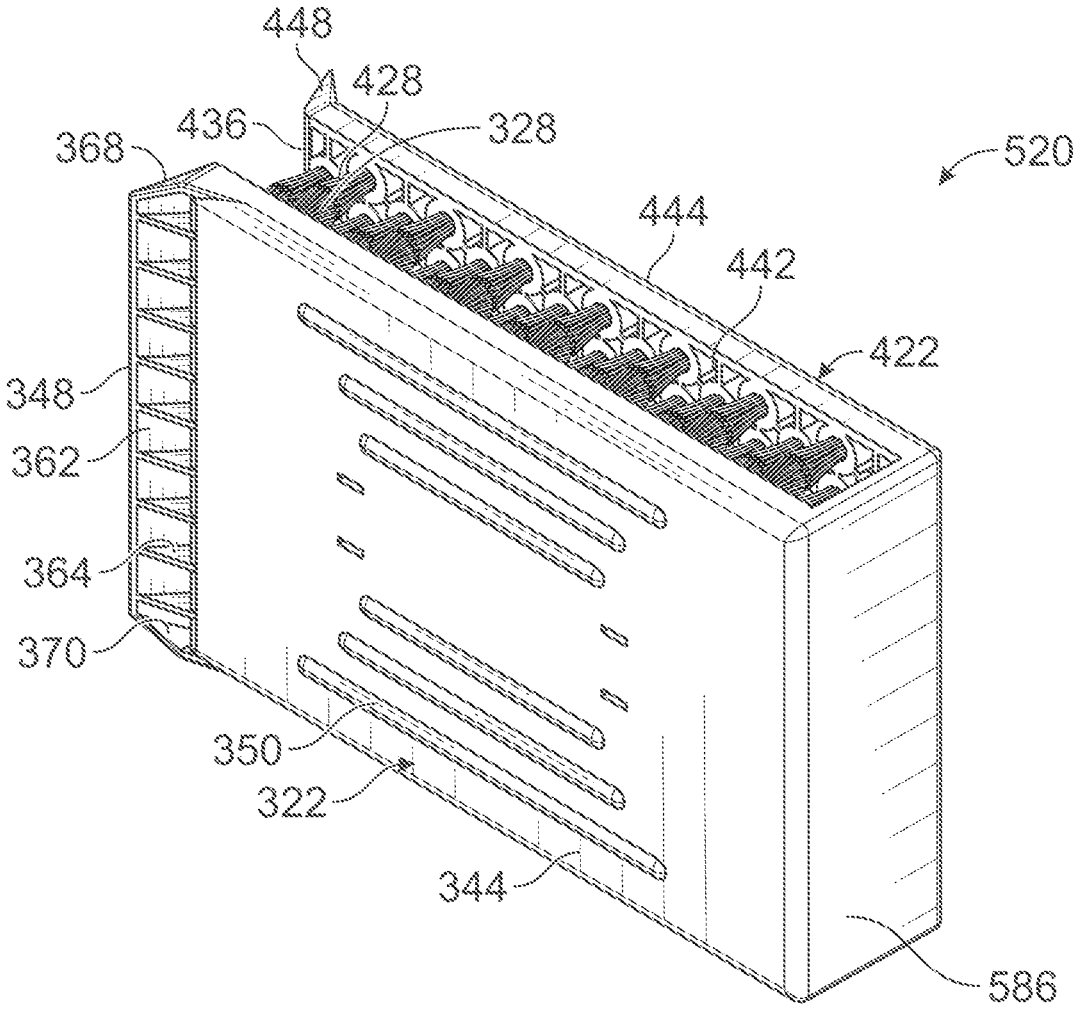
FIG. 11 depicts a perspective view of a cleaning brush in accordance with a third embodiment of the disclosure.
Figure 12:
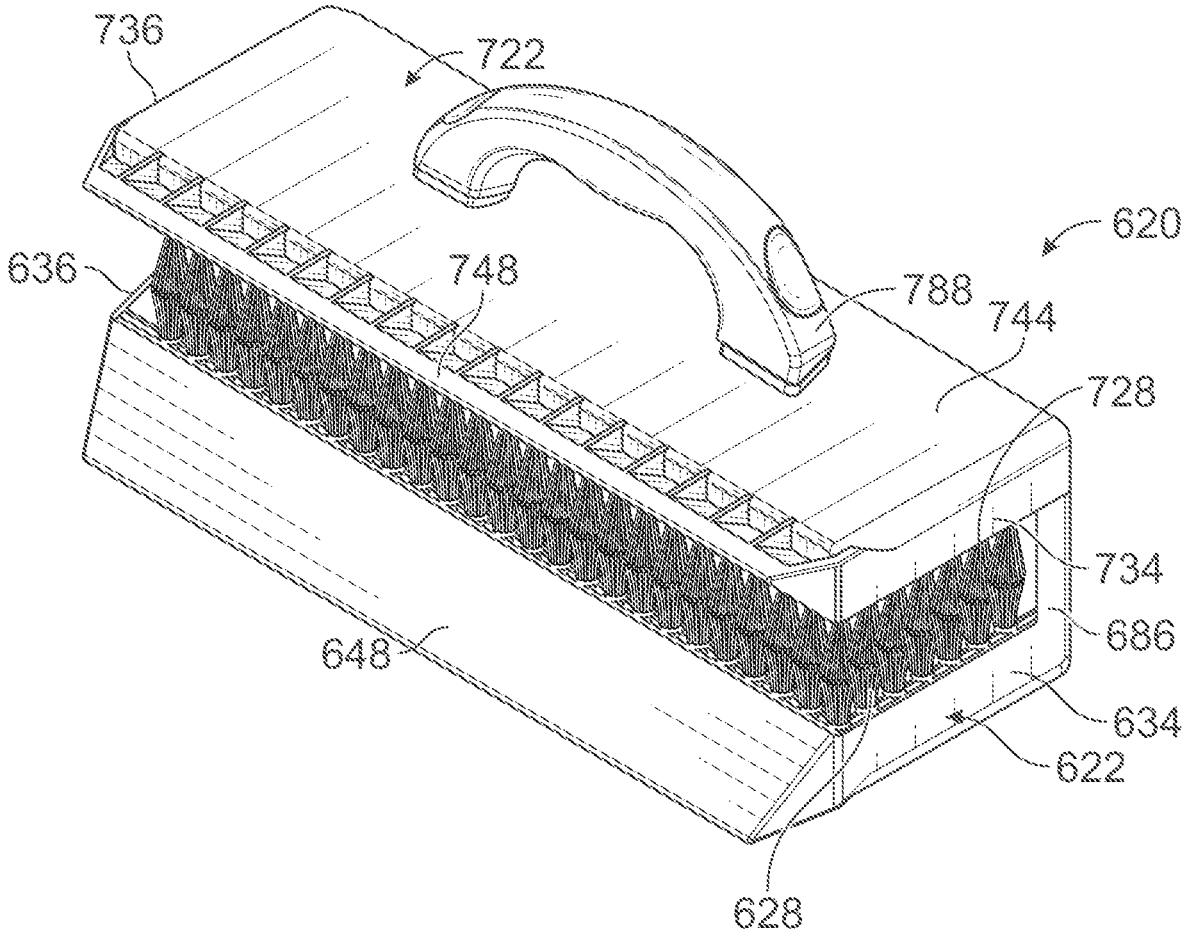
FIG. 12 depicts a perspective view of a cleaning brush in accordance with a fourth embodiment of the disclosure.
Figure 13:
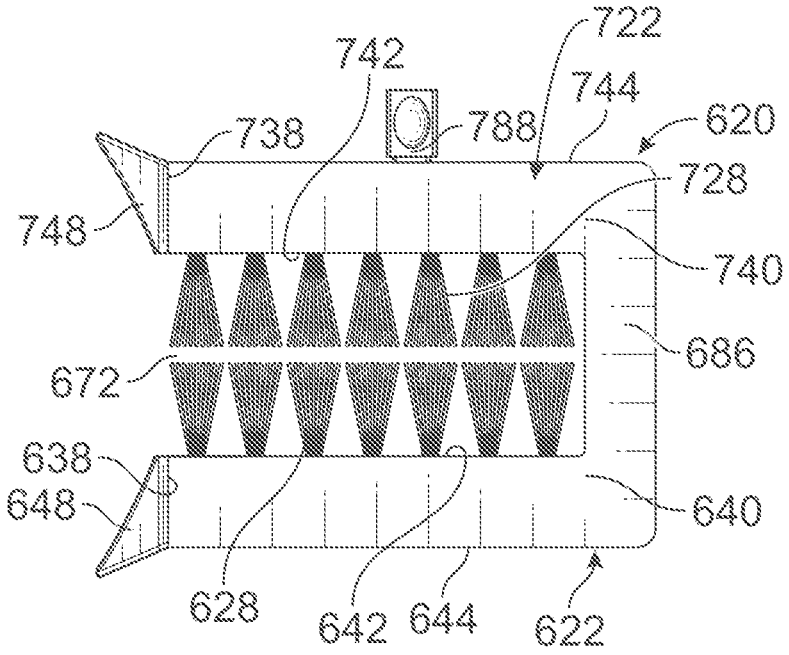
FIG. 13 depicts an end plan view of the cleaning brush of FIG. 12.

FIGS. 1-4 illustrate a first embodiment of a cleaning brush 20 for use in cleaning tools. FIGS. 5-10 illustrate a second embodiment of a cleaning brush 320 for use in cleaning tool. FIG. 11 illustrates a third embodiment of a cleaning brush 520 for use in cleaning tools. FIGS. 12 and 13 illustrate a fourth embodiment of a cleaning brush 620 for use in cleaning tools. The cleaning brush 20, 320, 520, 620 provides a user with the ability to efficiently clean the tools.

Attention is invited to the first embodiment of the cleaning brush 20 shown in FIGS. 1-4. The cleaning brush 20 of this embodiment provides a user with the ability to efficiently clean two different types of tools.

The cleaning brush 20 has a first rigid base part 22 having a first set 24 of flexible bristles 28 extending therefrom and a second set 30 of flexible bristles 32 extending therefrom, and a second rigid base part 122 having a first set 124 of flexible bristles 128 extending therefrom and a second set 130 of flexible bristles 132 extending therefrom. The base parts 22, 122 are coupled together, and the bristles 28, 128, 32, 132 are positioned between the base parts 22, 122.

Each base part 22, 122 has a body formed of a generally rectangular prism having a first end 34, 134, an opposite second end defined by a second wall surface 36, 136, and first and second side wall surfaces 38, 138, 40, 140 extending therebetween, and defining a first face 42, 142 and an opposite second face 44, 144. The first and second side wall surfaces 38, 138, 40, 140 are parallel to each other, but may have a central curvature therein to allow for easier gripping. The faces 42, 142, 44, 144 are parallel to each other. All corners between the walls may be chamfered or rounded to prevent sharp edges. Each base part 22, 122 further includes a coupler 46, 146 extending outwardly from the first face 42, 142, and a scraper 48, 148 extending forwardly from the first end 34, 134 and which may be integrally formed therewith.

Each base part 22, 122 may be made of plastic, such as acrylonitrile butadiene styrene (ABS). Each face 44, 144 may have a plurality of elongated ribs 50, 150 (shown only on face 44) formed therein to assist the user with gripping the cleaning brush 20.

The coupler 46, 146 is provided at the midpoint of the base parts 22, 122 and extends parallel to a centerline of the base parts 22, 122. The coupler 46, 146 is spaced from each side wall surface 38, 138, 40, 140 such that a first bristle area 52, 152 is defined on one side of the coupler 46, 146 and a second bristle area 54, 154 is defined on the other side of the coupler 46, 146. The coupler 46, 146 may extend along a portion of the base parts 22, 122 as shown, or may extend along the entire length of the base parts 22, 122. The coupler 46, 146 defines a height between the first face 42, 142 of the base part 22, 122 and an outward end 56, 156 of the coupler 46, 146. The coupler 46, 146 has a first longitudinally extending side wall 58, 158 which is proximate to the first bristle area 52, 152, and a second longitudinally extending side wall 60, 160 which is proximate to the second bristle area 54, 154. Each side wall 58, 158, 60, 160 is planar.

The scraper 48, 148 extends between the side wall surfaces 38, 138, 40, 140 and is generally triangular in cross-section. The scraper 48, 148 has a first wall 62, 162 which extends at an angle A from the first face 42, 142, and a second wall 64, 164 which extends at an angle B from the first face 42, 142; the walls 62, 162, 64, 164 form an outward edge 66, 166 that is perpendicular to the centerline of the base part 22, 122. The second wall 64, 164 may be formed by a plurality of spaced apart ribs. Angle B is measured from a line parallel to the first face 42, 142. As shown, angle A is greater than angle B. The scraper 48, 148 further has a first side wall 68, 168 extending at angle C from the first side wall surface 38, 138, and a second side wall 70, 170 extending at the same angle C from the second side wall 40, 140. Side walls 68, 168, 70, 170 angle inward toward each other and toward a centerline of the base parts 22, 122. In an embodiment, each side wall 68, 168, 70, 170 angles at an angle C of 30 degrees. This prevents the scraper 48, 148 from forming sharp corners along the sides.

The first set 24, 124 of bristles 28, 128 is formed by spaced apart groups of hairs and may be laid out in offsetting columns and rows provided in the first bristle area 52, 152. The first row is proximate to the first side wall surface 38, 138, and a row is proximate to the side wall 58, 158 of the coupler 46, 146. If the coupler 46, 146 does not extend the full length of the base parts 22, 122, one or more groups of hairs may be provided between the end of the coupler 46, 146 and the first end 34, 134 of the base part 22, 122 and between the end of the coupler 46, 146 and the second wall surface 36, 136. The second set 30, 130 of bristles 32, 132 is formed by groups of hairs laid out in offsetting columns and rows and provided in the second bristle area 54, 154. The first row is proximate to the second side wall 40, 140, and a row is proximate to the side wall 60, 160 of the coupler 46, 146. If the coupler 46, 146 does not extend the full length of the base part 22, 122, one or more groups of hairs may be provided between the end of the coupler 46, 146 and the first end 34, 134 of the base part 22, 122 and between the end of the coupler 46, 146 and the second wall surface 36, 136.

The bristles 28, 128 in the first sets 24, 124 have different properties than the bristles 32, 132 in the second sets 30, 130. The bristles 28, 128 in the first sets 24, 124 may be longer than the bristles 32, 132 in the second sets 30, 130. The bristles 28, 128 in the first sets 24, 124 may be harder than, or softer than, the bristles 32, 132 in the second sets 30, 130. One of the sets of bristles may have the same height as, or may have substantially the same height as, the coupler 46, 146, and the other sets of bristles may be have a height which is less the coupler 46, 146. Alternatively, the sets of bristles may have the same hardness and/or may have the same height.

The couplers 46, 146 are coupled together such that their outward ends 56, 156 abut against each other. The outward ends 56, 156 may be adhesively secured to each other to secure the base parts 22, 122 to form a one-piece unit, or fasteners may be provided through the couplers 46, 146 to secure the base parts 22, 122 to each other to form a one-piece unit. Alternatively, one coupler 46, 146 may have recesses and the other coupler 46, 146 has fingers which snap fit into the recesses to secure the base parts 22, 122 together. The second wall surface 36 of the first base part 22 generally aligns with an inner end of the scraper 148 of the second base part 122; the second wall surface 136 of the second base part 122 generally aligns with an inner end of the scraper 48 of the first base part 22. Other suitable means for coupling the couplers 46, 146 are within the scope of the present disclosure.

The bristles 28 in the first set 24 of the first base part 22 face the bristles 128 in the first set 124 of the second base part 122; the bristles 32 in the second set 30 of the first base part 22 face the bristles 132 in the second set 30, 130 of the second base part 12. Free ends of the bristles 28, 128 in the first sets 24, 124 may touch each other, or may be spaced there apart as shown such that a small gap 72 (1 mm for example) is provided therebetween. The bristles 32 in the second set 30 of the first base part 22 are spaced from the bristles 132 in the second set 130 of the second base part 122 such that a gap 74 is provided therebetween. The gap 74 is substantially larger than the gap 72 (gap 72 may be eliminated).

Figure 14:
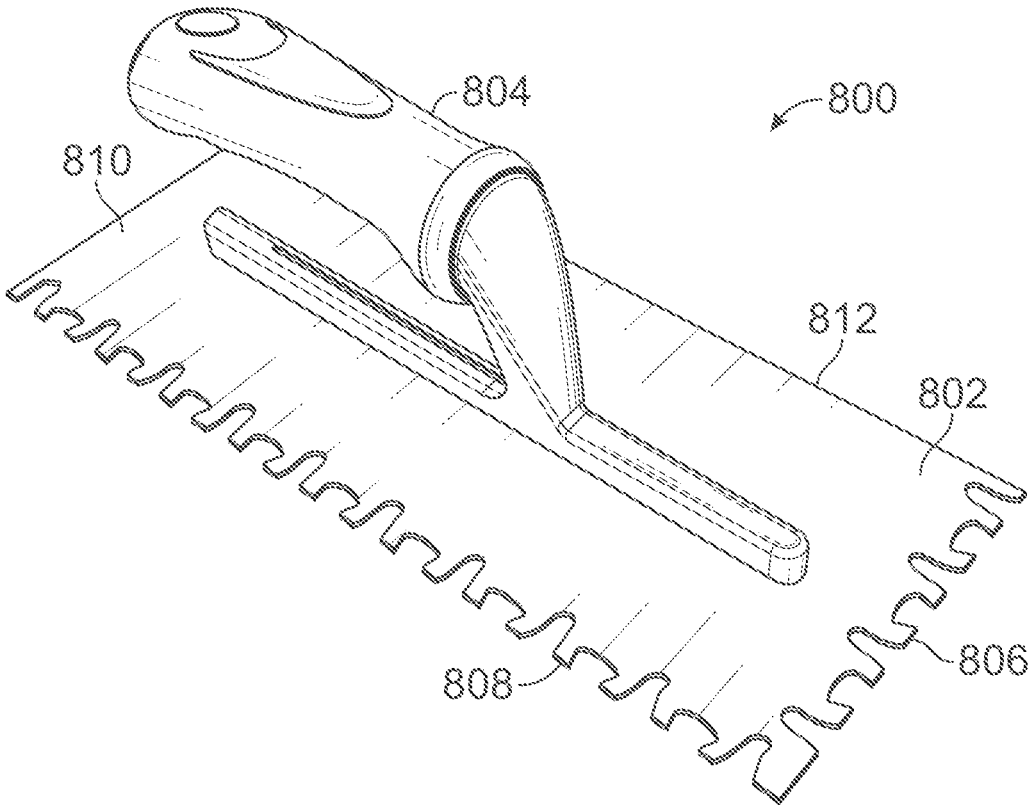
FIGS. 14 and 15 depict perspective view of tools that may be cleaned by the cleaning tool.
Figure 15:
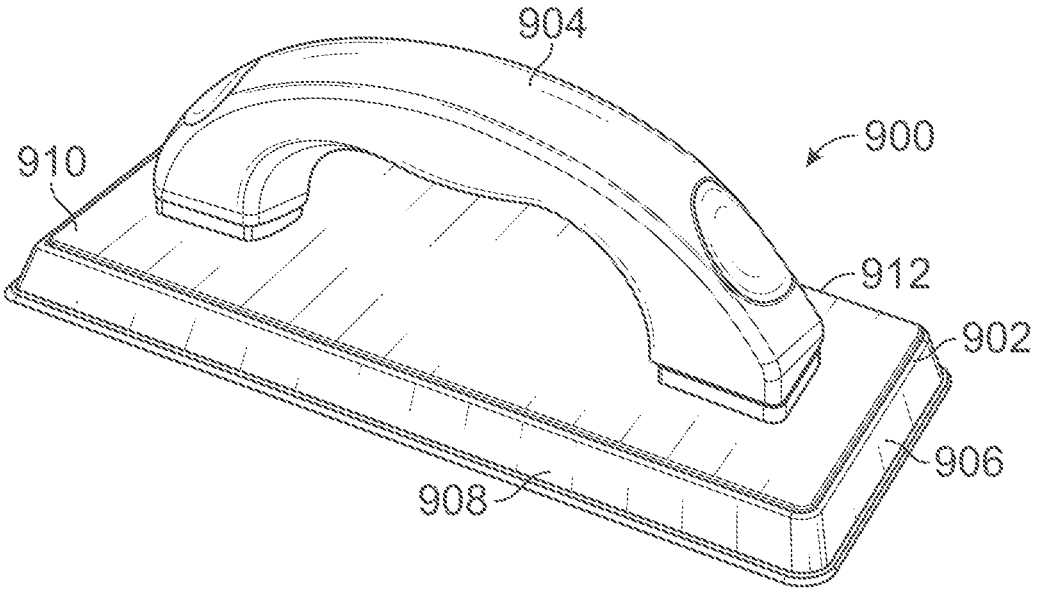

In use, a user inserts a thin tool between the bristles 28, 128 in the first sets 24, 124, the cleaning brush 20 and the thin tool are moved relative to each other, and the bristles 28, 128 on each side of the thin tool will agitate and remove contaminants on the thin tool. Since bristles 28, 128 are provided on both sides of the thin tool, the thin tool is quickly cleaned. An example of such a thin tool is illustrated in FIG. 14 as a trowel 800, although use of the cleaning brush 20 is not limited to such a tool. In use, a user inserts a thicker tool between the bristles 32, 132 in the second sets 30, 130, the cleaning brush 20 and the thicker tool are moved relative to each other, and the bristles 32, 132 on each side of the thicker tool will agitate and remove contaminants on the thicker tool. Since bristles 32, 132 are provided on both sides of the thicker tool, the thicker tool is quickly cleaned. An example of such a thicker tool is illustrated in FIG. 15 as a grout float 900, although use of the cleaning brush 20 is not limited to such a tool.

As shown in FIG. 14, the trowel 800 typically includes a blade 802 and a handle 804. The blade 802 is generally rectangular and a height of the blade 802 is defined between upper and lower surfaces thereof. The handle 804 may be centered on the upper surface of the blade 802 to divide the blade 802 into a right section and a left section (the terms "right" and "left" being determined by the orientation of the trowel 800, the end of the trowel 800 being to the right in FIG. 14 arbitrarily being designated the "front" of the trowel 800). As shown in FIG. 14, the handle 804 has an end affixed to the upper surface of the blade 802 and is generally L-shaped. The handle 804 may be enclosed in a layer of resilient material. The metal used to form the blade 802 is thin, and has sharp edges that can cut through towels or sponges. As shown in FIG. 14, a front edge 806 of the trowel 800 has serrated notches, one side edge 808 of the trowel 800 has serrated notches, and the other edges 810, 812 are straight. Alternatively, some trowels 800 have flat metal edges on all sides. As shown in FIG. 15, the grout float 900 typically includes a blade 902 and a handle 904. The blade 902 is generally rectangular and a height of the blade 902 is defined between upper and lower surfaces thereof. The handle 904 may be centered on the upper surface of the blade 902 to divide the blade 902 into a right section and a left section (the terms "right" and "left" being determined by the orientation of the grout float 900, the end of the grout float 900 being to the right in FIG. 15 arbitrarily being designated the "front" of the grout float 900). As shown in FIG. 15, the handle 904 has opposite ends affixed to the upper surface of the blade 902. The handle 904 may be enclosed in a layer of resilient material. The lower edges of walls 906, 908, 910, 912 of the grout float 900 are straight. The height of the blade 902 of the grout float 900 is greater than the height of the blade 802 of the trowel 800.

In use, the tile installer inserts the thin metal blade 802 of the trowel 800 between the bristles 28, 128 in the first sets 24, 124. The cleaning brush 20 and blade 802 are moved relative to each other and the bristles 28, 128 on each side of the blade 802 will agitate and remove the adhesives, and any other compounds like cementitious mortar that typically adhere to the blade 802. Since bristles 28, 128 are provided on both sides of the trowel 800, the trowel 800 is quickly cleaned. Edge 806, 808, 810 or 812 of the trowel 800 engages with the side walls 58, 158 of the coupler 46, 146 which prevents the passage of the trowel 800 into the gap 74. Alternatively, in use, the tile installer inserts the thicker blade 902 of the grout float 900 into the gap 74 between the bristles 32, 132 the second sets 30, 130. The cleaning brush 20 and blade 902 are moved relative to each other and the bristles 32, 132 on each side of the blade 902 will agitate and remove the adhesives, and any other compounds like cementitious mortar that typically adhere to the blade 902. Since bristles 32, 132 are provided on both sides of the grout float 900, the grout float 900 is quickly cleaned. The walls 906, 908, 910 or 912 of the grout float 900 engages with the side walls 60, 160 of the coupler 46, 146 which prevents the passage of the grout float 900 between the bristles 28, 128 in the first sets 24, 124. Prior to inserting the tile grout tool 800, 900 between the bristles 28, 128 or bristles 32, 132, the tile installer can engage the edge 66, 166 of one (or both in succession) of the scrapers 48, 148 against the flat surfaces of the blades 802, 902 to remove excess material thereon.

Either base part 22, 122, or both base parts 22, 122, can have a handle (not shown) provided thereon.

Attention is invited to the second embodiment of the cleaning brush 320 shown in FIGS. 5-10. The cleaning brush 320 of this embodiment provides a user with the ability to efficiently clean two tools, which may be the same type of tool or different types of tools.

The cleaning brush 320 has a first rigid base part 322 having a set of flexible bristles 328 extending therefrom, and a second rigid base part 422 having a set of flexible bristles 428 extending therefrom. The base parts 322, 422 are coupled together, and the bristles 328, 428 are positioned between the base parts 322, 422. The set of bristles 328 is formed by spaced apart groups of hairs laid out in offsetting columns and rows. The set of bristles 428 is formed by spaced apart groups of hairs and may be laid out in offsetting columns and rows. Each bristle 328, 428 has the same height. The coupler 46, 146 acts as a divider to divide the sets of bristles.

The base part 322 is identically formed to that of base part 22 except for the differences noted herein; therefore the specifics are not repeated and the same components are denoted by the same reference number, but in the three hundreds. The base part 422 is identically formed to that of base part 122 except for the differences noted herein; therefore the specifics are not repeated and the same components are denoted by the same reference number, but in the four hundreds.

The coupler 46, 146 of the first embodiment is provided by coupler 376 in this embodiment. It is to be understood that the coupler 46, 146 of the first embodiment can be provided in this embodiment, and the coupler 376 can be provided in the first embodiment. The coupler 376 is provided at the midpoint of the base parts 322, 422 and extends parallel to centerlines of the base parts 322, 422. The coupler 376 secures the base parts 322, 422 together. The coupler 376 is spaced from each side wall surface 338, 438, 340, 440 such that a first bristle area is defined on one side of the coupler 376 on each base part 322, 422, and a second bristle area is defined on the other side of the coupler 376 on each base part 322, 422. The coupler 376 may extend along a portion of the base parts 322, 422 as shown, or may extend along the entire length of the base parts 322, 422. As shown in this embodiment in FIG. 7, the coupler 376 is provided by a projection 378, 478 that extends from the respective base part 322, 422 and an elongated tube 380. The projections 378, 478 have barbs which snap into openings in the tube 380, see FIGS. 9 and 10. The tube 380 has a first longitudinally extending side wall surface 382 which is proximate to the first bristle area, and a second longitudinally extending side wall surface 384 which is proximate to the second bristle area. Each side wall surface 382, 384 is planar. Other forms of the coupler 376 may be provided.

A row of bristles 328, 428 is proximate to the first side wall 338, 438, a row is proximate to the side wall surface 382 of the coupler 376, a row is proximate to the side wall surface 384 of the coupler 376, and a row is proximate to the second side wall 340, 440. If the coupler 376 does not extend the full length of the base parts 322, 422, one or more groups of hairs may be provided between the ends of the coupler 376 and the ends of the base parts 322, 422. The bristles 328, 428 are the same length. The bristles 328, 428 may have the same hardness. The bristles 328 extending from the first base part 322 face the bristles 428 extending from the second base part 422. Free ends of the bristles 328, 428 may touch each other, or may be spaced there apart as shown such that a small gap (1 mm for example) is provided therebetween.

In use, the tile installer inserts the tool, which may be metal blade 802 of the trowel 800, between the bristles 328, 428. The brush 320 and blade 802 are moved relative to each other and the bristles 328, 428 on each side of the blade 802 will agitate and remove the contaminants, such as adhesives, and any other compounds like cementitious mortar that typically adhere to the blade 802. Since bristles 328, 428 are provided on both sides of the tool, the tool is quickly cleaned. The edge of the tools, such as edge 806, 808, 810 or 812 of the trowel 800, engages with the side wall surfaces 382 or 384 (depending upon which side the tool is inserted into the cleaning brush 320) and the coupler 376 prevents the passage of the tool into the bristle area on the other side of the coupler 376. Prior to inserting the tool between the bristles 328, 428, the user can engage the edge 366, 466 of one (or both in succession) of the scrapers 348, 448 against the flat surfaces of the tool to remove excess material thereon.

Either base part 322, 422, or both base parts 322, 422, can have a handle (not shown) provided thereon.

Attention is invited to the third embodiment of the cleaning brush 520 shown in FIG. 11. The cleaning brush 520 of this embodiment provides a user with the ability to efficiently clean two tools, which may be the same type of tool or different types of tools.

The cleaning brush 520 is identical to the cleaning brush 320 shown in FIGS. 5-10, and only the differences are described. The scraper 448 is now provided at the end 436 of the base part 422 and the opposite ends of the base parts 322, 422 are closed off by a secondary coupler formed of a wall 586, such that the base parts 322, 422 and the wall 586 form a C-shape. This provides a convenient area for a user to hold the cleaning brush 520 without touching the bristles 28, 32, 128, 132. While the cleaning brush 520 is shown with bristles 328 and 428, the sets 24, 30, 124, 130 of flexible bristles 28, 32, 128, 132 as described in the first embodiment can instead be provided. Either base part 322, 422, or both base parts 322, 422, can have a handle (not shown) provided thereon.

Attention is invited to the fourth embodiment of the cleaning brush 620 shown in FIGS. 12 and 13. The cleaning brush 620 of this embodiment provides a user with the ability to efficiently clean two different types of tools.

The cleaning brush 620 has a first rigid base part 622 having flexible bristles 628 extending therefrom, and a second rigid base part 722 having flexible bristles 728 extending therefrom. The base parts 622, 722 are coupled together by a coupler formed by a wall 686, and the bristles 628, 728 are positioned between the base parts 622, 722.

Each base part 622, 722 has a body formed of a generally rectangular prism having a first end surface 34, 134, an opposite second end surface 36, 136, and first and second sides 638, 738, 740, 740 extending therebetween, and defining a first face 642, 742 and an opposite second face 644, 744. The faces 642, 742, 644, 744 are parallel to each other, and faces 642, 742 face each other. All corners between the walls may be chamfered or rounded to prevent sharp edges. Each base part 622, 722 may be made of plastic, such as acrylonitrile butadiene styrene (ABS). Each face 644, 744 may have a plurality of elongated ribs (now shown) formed therein to assist the user with gripping the cleaning brush 620.

The wall 686 extends between the sides 640, 740 such that the base parts 622, 722 and the wall 686 form a C-shape. This provides a convenient area for a user to hold the cleaning brush 620 without touching the bristles 628, 728.

The bristles 628, 728 may be formed by spaced apart groups of hairs and may be laid out in offsetting columns and rows. The bristles 628 face the bristles 728. Free ends of the bristles 628, 728 may touch each other, or may be spaced there apart as shown such that a small gap 72 (1 mm for example) is provided therebetween, or a larger gap (greater than 1 mm for example) is provided therebetween.

Each base part 622, 722 further includes a scraper 648, 748 extending outwardly from the sides 638, 738 and which may be integrally formed therewith. The scraper 648, 748 may be identically formed to scrapers 48, 148, except that the scraper 648, 748 extends between the end wall surfaces 634, 636, 734, 736.

Either base part 622, 722, or both base parts 622, 722, can have a handle 788 provided thereon which extends from the face 644, 744.

In use, a user inserts a thin tool between the bristles 628, 728 and the cleaning brush 620 and the thin tool are moved relative to each other, and the bristles 628, 128 on each side of the thin tool will agitate and remove contaminants on the thin tool. Since bristles 628, 728 are provided on both sides of the thin tool, the thin tool is quickly cleaned. An example of such a thin tool is illustrated in FIG. 14 as a trowel 800, although use of the cleaning brush 620 is not limited to such a tool.

While a trowel 800 and a grout float 900 are shown and described herein, the cleaning brush 20, 320, 520, 620 is not limited to cleaning only these types of tools.

Many modifications and other embodiments of the disclosure set forth herein will come to mind to one skilled in the art to which these disclosed embodiments pertain having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

While a particular embodiment is illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A cleaning brush for cleaning a tool comprising:

a first rigid base part and a second rigid base part, each base part having first and second opposite ends and first and second side wall surfaces extending between the first and second opposite ends thereby defining opposite first and second faces, and further having bristles extending from the respective first face, wherein the first faces are parallel to each other, and free ends of the bristles extending from the first rigid base part face free ends of the bristles extending from the second base part;

a coupler extending and attached between the first faces of the base parts such that a first set of the bristles is provided on each base part on a first side of the coupler and a second set of the bristles is provided on each base part on a second side of the coupler, the coupler preventing movement of the base parts relative to each other, wherein the coupler is devoid of bristles; and an opening extending continuously between the first ends of the base parts, between the first side wall surfaces of the base parts and between the second ends of the base parts, wherein the tool is configured to be inserted through the opening such that a first side of the tool is configured to contact the bristles extending from the first base part, a second side of the tool is configured to contact the bristles extending from the second base part and an edge of the tool is configured to contact the coupler.

2. The cleaning brush of claim 1, wherein the coupler is provided at a midpoint of the first and second base parts, and the bristles in the first sets are longer than the bristles in the second sets.

3. The cleaning brush of claim 2, wherein on each base part, one of the sets of the bristles is harder than the other set of the bristles, and/or wherein the free ends of the bristles in the first set on the first base part touch the free ends of the bristles in the first set on the second base part.

4. The cleaning brush of claim 2, wherein the free ends of the bristles in the second set on the first base part are spaced from the free ends of the bristles in the second set on the second base part by at least 1 mm.

5. The cleaning brush of claim 1, wherein the coupler is provided at a midpoint of the first and second base parts, and the bristles in the first sets have a same length as the bristles in the second sets.

6. The cleaning brush of claim 5, wherein on each base part, one of the sets of bristles is harder than the other set of the bristles, and/or wherein the free ends of the bristles in the first set on the first base part touch the free ends of the bristles in the first set on the second base part, and the free ends of the bristles in the second set on the first base part touch the free ends of the bristles in the second set on the second base part.

7. The cleaning brush of claim 5, wherein the free ends of the bristles in the first set on the first base part are spaced from the free ends of the bristles in the first set on the second base part by at least 1 mm, and the free ends of the bristles in the second set on the first base part are spaced from the free ends of the bristles in the second set on the second base part by at least 1 mm.

8. The cleaning brush of claim 1, wherein the bristles extending from the first base part includes spaced apart groups of hairs laid out in offsetting columns and rows, and the bristles extending from the second base part includes spaced apart groups of hairs laid out in offsetting columns and rows.

9. The cleaning brush of claim 1, further including a handle extending from at least one of the base parts.

10. The cleaning brush of claim 1, further comprising an angled wall having a sharpened edge extending from an edge of at least one of the base parts.

11. The cleaning brush of claim 1, wherein the coupler includes a first part on the first base part and a second part on the second base part, and wherein the first part of the coupler is fixedly attached to the second part of the coupler.

12. The cleaning brush of claim 11, wherein the first part of the coupler is fixedly attached to the second part of the coupler by one of adhesive, fasteners, a snap fit connection.

13. An assembly comprising the cleaning brush of claim 1 and a trowel or grout float.

14. A cleaning brush for cleaning a tool comprising:

a first rigid base part and a second rigid base part, each base part having first and second opposite ends and first and second side wall surfaces extending between the first and second opposite ends thereby defining opposite first and second faces, and further having bristles extending from the respective first face, wherein the first faces are parallel to each other;

a coupler provided at a midpoint of the first and second base parts and extending between the base parts such that a first set of the bristles is provided on each base part on a first side of the coupler and a second set of the bristles is provided on each base part on a second side of the coupler, wherein free ends of the bristles in the first sets face each other, and free ends of the bristles in the second sets face each other, the coupler preventing movement of the base parts relative to each other, wherein the coupler is devoid of bristles;

wherein the bristles in the first sets are longer than the bristles in the second sets; and an opening extending continuously between the first ends of the base parts, between the first side wall surfaces of the base parts and between the second ends of the base parts, wherein the tool is configured to be inserted through the opening such that a first side of the tool is configured to contact the bristles extending from the first base part, a second side of the tool is configured to contact the bristles extending from the second base part and an edge of the tool is configured to contact the coupler.

15. The cleaning brush of claim 14, further including a handle extending from at least one of the base parts.

16. The cleaning brush of claim 14, further comprising an angled wall having a sharpened edge extending from an edge of at least one of the base parts.

17. The cleaning brush of claim 14, wherein the bristles extending from the first base part includes spaced apart groups of hairs laid out in offsetting columns and rows, and wherein the bristles extending from the second base part includes spaced apart groups of hairs laid out in offsetting columns and rows.

18. An assembly comprising the cleaning brush of claim 14 and a trowel or grout float.

19. The cleaning brush of claim 14, wherein on each base part, one of the sets of the bristles is harder than the other set of the bristles, and/or wherein the free ends of the bristles in the first set on the first base part touch the free ends of the bristles in the first set on the second base part.

20. The cleaning brush of claim 19, wherein the free ends of the bristles in the second set on the first base part are spaced from the free ends of the bristles in the second set on the second base part by at least 1 mm.

* * * * *